US007428374B2

(12) United States Patent
Franke et al.

(10) Patent No.: US 7,428,374 B2
(45) Date of Patent: Sep. 23, 2008

(54) HORIZONTALLY ASSEMBLED STEAM GENERATOR

(75) Inventors: Joachim Franke, Altdorf (DE); Rudolf Kral, Stulln (DE); Eberhard Wittchow, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 560 days.

(21) Appl. No.: 10/527,279

(22) PCT Filed: Aug. 28, 2003

(86) PCT No.: PCT/EP03/09571

§ 371 (c)(1),
(2), (4) Date: Mar. 8, 2005

(87) PCT Pub. No.: WO2004/025177

PCT Pub. Date: Mar. 25, 2004

(65) Prior Publication Data

US 2005/0257753 A1 Nov. 24, 2005

(30) Foreign Application Priority Data

Sep. 10, 2002 (EP) ..... 02020252

(51) Int. Cl.
*F22B 29/06* (2006.01)

(52) U.S. Cl. ..... 392/396; 122/406.4

(58) Field of Classification Search ..... None
See application file for complete search history.

(56) References Cited

U.S. PATENT DOCUMENTS

| | | | |
|---|---|---|---|
| 601,970 | A | 4/1898 | Larson et al. |
| 3,442,324 | A | 5/1969 | Clay et al. |
| 4,188,916 | A | 2/1980 | Csathy et al. |
| 5,353,749 | A | 10/1994 | Seibel et al. |

FOREIGN PATENT DOCUMENTS

| | | |
|---|---|---|
| CA | 1254458 | 5/1989 |
| CN | 1239540 | 12/1999 |
| DE | 34 41 972 A1 | 5/1986 |
| EP | 0 450 072 A1 | 10/1991 |
| EP | 0 944 801 B1 | 9/1999 |

*Primary Examiner*—Thor S Campbell

(57) ABSTRACT

Disclosed is a steam generator in which a continuous evaporating heating area is disposed within a heating gas duct that is penetrated in a nearly horizontal direction by a heating gas. Said continuous evaporating heating area comprises a number of steam-generating pipes that are connected in parallel and are penetrated by a flowing medium and is configured such that a steam-generating pipe which is heated more than another steam-generating pipe of the same continuous evaporating heating area has a higher throughput of the flowing medium than said other steam-generating pipe. The aim of the invention is to create a steam generator which provides a particularly high degree of stability of flow during operation of the continuous evaporating heating area while keeping the structural complexity and design comparatively simple. Said aim is achieved by means of a discharge collector which is mounted downstream of the steam-generating pipes of the continuous evaporating heating area on the side of the flowing medium, and the longitudinal axis of which is located essentially parallel to the direction of the heating gas.

9 Claims, 5 Drawing Sheets

HORIZONTALLY ASSEMBLED STEAM GENERATOR

CROSS REFERENCE TO RELATED APPLICATION

This application is the US National Stage of International Application No. PCT/EP2003/009571, filed Aug. 28, 2003 and claims the benefit thereof. The International Application claims the benefits of European Patent application No. 02020252.9 EP filed Sep. 10, 2002, both of the applications are incorporated by reference herein in their entirety.

FIELD OF THE INVENTION

The invention relates to a steam generator in which an evaporator/once-through heating area is disposed within a heating-gas duct through which a flow can be conducted in an approximately horizontal heating-gas direction, said evaporator/once-through heating area comprising a number of steam-generator tubes connected in parallel for a through-flow of a flow medium and being configured such that a steam-generator tube which is heated to a greater extent compared with a further steam-generator tube of the same evaporator/once-through heating area has a higher throughput of the flow medium compared with said further steam-generator tube.

BACKGROUND OF THE INVENTION

In a gas- and steam-turbine plant, the heat contained in the expanded working medium or heating gas from the gas turbine is utilized for generating steam for the steam turbine. The transfer of heat is effected in a waste-heat steam generator which is disposed downstream of the gas turbine and in which a number of heating areas for preheating water, for generating steam and for superheating steam are normally disposed. The heating areas are connected to the water/steam circuit of the steam turbine. The water/steam circuit normally comprises several, e.g. three, pressure stages, whereby each pressure stage may have an evaporator heating area.

For the steam generator disposed as a waste-heat steam generator downstream of the gas turbine on the heating-gas side, a number of alternative configuration concepts are suitable, namely the configuration as a once-through steam generator or the configuration as a circulation steam generator. In the case of a once-through steam generator, the heating of steam-generator tubes provided as evaporator tubes leads to evaporation of the flow medium in the steam-generator tubes in a single pass. In contrast, in the case of a natural- or forced-circulation steam generator, the water in circulation is only partly evaporated when passing through the evaporator tubes. After separation of the generated steam, the water that is not evaporated in the process is fed again to the same evaporator tubes for further evaporation.

A once-through steam generator, in contrast to a natural- or forced-circulation steam generator, is not subject to any pressure limitation so that it can be configured for live-steam pressures well above the critical pressure of water ($P_{Cri} \approx 221$ bar), where no differentiation between the water and steam phases and therefore also no separation of the phases is possible. A high live-steam pressure promotes a high thermal efficiency and thus low $CO_2$ emissions in a fossil-fired power station. In addition, a once-through steam generator has a simple type of construction compared with a circulation steam generator and can therefore be manufactured at an especially low cost. The use of a steam generator configured according to the once-through principle as a waste-heat steam generator of a gas- and steam-turbine plant is therefore especially favorable for achieving a high overall efficiency of the gas- and steam-turbine plant in a simple type of construction.

Particular advantages with regard to the manufacturing cost as well as with regard to required maintenance work are offered by a waste-heat steam generator with a horizontal type of construction in which the heating medium or heating gas, i.e. the waste gas from the gas turbine, is conducted in an approximately horizontal direction of flow through the steam generator. In a steam generator with a horizontal type of construction, the steam-generator tubes of a heating area may, however, be exposed to widely differing heating, depending on their positioning. Particularly where steam-generator tubes of a once-through steam generator are connected on the outlet side to a common collector, different heating of individual steam-generator tubes may lead to the merging of steam flows having steam parameters differing greatly from one another and thus to undesirable efficiency losses, in particular to a comparative reduction in the effectiveness of the heating area concerned and consequently to a reduction in steam generation. Different heating of adjacent steam-generator tubes, particularly in the region where they lead into collectors, may also result in damage to the steam-generator tubes or the collector. The inherently desirable use of a once-through steam generator with a horizontal type of construction as a waste-heat stem generator for a gas turbine can thus bring with it considerable problems with regard to an adequately stabilized flow.

A steam generator is known from EP 0 944 801 B1 which is suitable for a configuration in a horizontal type of construction and which also has the aforementioned advantages of a once-through steam generator. To this end, the evaporator heating area of the known steam generator is connected up as a once-through heating area and configured such that a steam-generating tube which is heated to a greater extent compared with a further steam-generator tube of the same once-through heating area has a higher throughput of the flow medium than the further steam-generator tube. Here, the expression once-through heating area refers in general to a heating area that is configured for a through flow according to the once-through principle. The flow medium fed to the evaporator heating area connected as a once-through heating area is thus completely evaporated in a single pass through this once-through heating area or through a heating-area system comprising a plurality of once-through heating areas connected one behind the other.

The evaporator heating area of the known steam generator which is connected up as a once-through heating area thus exhibits, in the type of flow characteristic of a natural-circulation evaporator heating area (natural-circulation characteristic) where different degrees of heating of individual steam-generator tubes occurs, a self-stabilizing behavior which leads, without the need for external influence to be exerted to a balancing of the temperatures on the outlet side even in steam-generator tubes heated differently and connected in parallel on the flow-medium side.

The known steam generator has an evaporator system with a multi-stage design, in which a further evaporator/once-through heating area is connected downstream of a first once-through heating area on the flow-medium side. In order to ensure a reliable and comparatively homogeneous overflow of the flow medium from the first to the second once-through heating area, the known steam generator is fitted with a complex distributor system which requires a comparatively high outlay in terms of construction and design.

SUMMARY OF THE INVENTION

The object of the invention is therefore to provide a steam generator of the aforementioned type in which a particularly high degree of flow stability during operation of the evaporator heating area connected as a once-through heating area or evaporator/once-through heating area can be achieved at a comparatively low construction and design cost.

This object is achieved according to the invention in that a discharge collector connected downstream of the steam-generator tubes of the evaporator/once-through heating area on the flow-medium side is oriented with its longitudinal axis essentially parallel to the heating-gas direction.

The invention is based on the idea that the construction and design cost in setting up the steam generator can be kept low by reducing to a particular extent the number of component types used. Such a reduction of components can be achieved in the case of the steam generator of the aforementioned type by economizing on the distributor system connected downstream of the once-through heating area, by making consistent use of the property of the once-through heating area which is in any case provided, namely the self-stabilizing circulation characteristic. It is precisely because of this characteristic that the mixing of the flow medium flowing out of different steam-generator tubes connected in parallel to one another and its transfer to the heating-area system connected downstream, without any significant impairment of the homogenization achieved by the mixing can be shifted from a downstream distributor system to the discharge collector connected in any case downstream of the steam-generator tubes, without this leading to any significant flow instabilities or other problems. Accordingly, the comparatively costly distributor system can be dispensed with. A design of the discharge collector that is appropriate for this purpose, namely for the appropriate mixing and forwarding of the flow medium flowing out of the steam-generator tubes, can be achieved whereby the steam-generator tubes of the evaporator/once-through heating area which are arranged behind one another, viewed in the heating-gas direction, and are thus, in terms of their heating profile, exposed to locally differing levels of heating discharge at the outlet end into a common collecting chamber. Such a common collecting chamber for the steam-generator tubes arranged behind one another, viewed in the heating-gas direction, is enabled by the discharge collector being oriented with its longitudinal axis essentially parallel to the heating-gas direction.

A particularly simple method of construction of the discharge collector can intrinsically be achieved by fashioning said discharge collector essentially as a cylindrical body.

For a type of construction that is kept relatively simple, the evaporator/once-through heating area preferably comprises, in the manner of a nest of tubes, a number of tube layers arranged behind one another, viewed in the heating-gas direction, each of which tube layers is formed of a number of heat-generating tubes arranged side-by-side, viewed in the heating-gas direction. A common discharge collector could in each case be assigned to an appropriate number of heat-generating tubes of each tube layer. The distribution of the flow medium downstream of the once-through heating area on the flow-medium side, saving the need for a costly distributor system, may, however, be effected particularly simply, whereby a number of discharge collectors oriented with their longitudinal axis essentially parallel to the heating-gas direction, said number corresponding to the number of heat-generating tubes in each tube layer, is assigned in a further advantageous design of the once-through heating area. Here, in each case one heat-generating tube of each tube layer discharges into each discharge collector.

The evaporator system of the steam generator is preferably fashioned in the manner of a multi-stage design, whereby the evaporator/once-through heating area is provided in the manner of a pre-evaporator for the appropriate conditioning of the flow medium prior to its entry into a further evaporator/once-through heating area connected downstream of said first evaporator/once-through heating area. The further evaporator/once-through heating area therefore serves as a type of second evaporator stage for completing the evaporation of the flow medium.

The further evaporator/once-through heating area is also in itself usefully configured for a self-stabilizing flow behavior through the consistent use of a natural circulation characteristic in the respective steam-generator tubes. To this end, the further evaporator/once-through heating area advantageously comprises a number of steam-generator tubes connected in parallel for through flow by the flow medium. It is usefully also configured such that a steam-generator tube which is heated to a greater extent compared with a further steam-generator tube of the further evaporator/once-through heating area has a higher throughput of the flow medium compared with said further steam-generator tube.

Whereas the evaporator/once-through heating area of the steam generator is usefully formed of steam-generator tubes oriented essentially vertically and provided for through flow by the flow medium from bottom to top, the further evaporator/once-through heating area is in an especially advantageous embodiment formed from steam-generating tubes fashioned in a U-shape. In this embodiment, the steam-generator tubes forming the further evaporator/once-through heating area each have a downtake section, which is disposed approximately vertically and through which the flow medium can flow in a downward direction, and an uptake section, which is connected downstream of said downtake section on the flow-medium side and is disposed approximately vertically and through which the flow medium can flow in an upward direction.

In the design of the further evaporator/once-through heating area with U-shaped steam-generator tubes, steam bubbles forming in the downtake sections could rise counter to the direction of flow of the flow medium and thereby impair the stability of the flow in an undesirable way. In order to prevent this, the evaporator system is advantageously configured consistently to carry such steam bubbles along with the flow medium.

In order reliably to ensure this desired effect of consistently carrying along any steam bubbles which may be present in the downtake section of a steam-generator tube of the further once-through heating area, the once-through heating area is usefully dimensioned such that, when in operation, the flow medium flowing into the further once-through heating area connected downstream of said once-through heating area has a flow velocity greater than the minimum velocity required for carrying along any steam bubbles which occur.

Due to the essentially U-shaped design of the steam-generator tubes which form the further once-through heating area, their intake area is located in the upper region of or above the heating-gas duct. Here, consistent use of the discharge collectors, which are assigned to the evaporator/once-through heating area, are disposed above the heating-gas duct and are oriented with their longitudinal direction in each case essentially parallel to the direction of flow of the heating gas, enables an interconnection of the evaporator/once-through heating area and the further evaporator/once-through heating area at especially low cost in that the discharge collector or each discharge collector of the evaporator/once-through heating area is integrated with a respectively assigned entry collector of the evaporator/once-through heating area connected downstream on the flow-medium side in an advantageous design into a structural unit. Such an arrangement enables a direct overflow of the flow medium being discharged from the first evaporator/once-through heating area into steam-generator tubes of the further evaporator/once-through heating area which are connected downstream on the flow-medium side. Costly distributor or connection lines between the discharge collector of the evaporator/once-through heating area and the entry collector of the further evaporator/once-through heating area, as well as assigned mixing and distributor elements can be dispensed with, and the line layout is in general relatively simple.

In a further advantageous embodiment, the steam-generator tubes of the further evaporator/once-through heating area are connected at the inlet end to the entry collectors assigned to each of them in a common plane oriented perpendicularly to the longitudinal axis of the discharge collectors and thus perpendicularly to the heating-gas direction. Such an arrangement ensures that the partly evaporated flow medium to be fed to the further evaporator/once-through heating area, starting from the part of the integrated unit used as a discharge collector for the first evaporator/once-through heating area, first strikes the base of the part of the structural unit used for the further evaporator/once-through heating area, is swirled once again there and then flows out with virtually identical two-phase proportions into the steam-generator tubes of the further evaporator/once-through heating area which are connected to the respective entry collector. Forwarding of the flow medium into the steam-generator tubes of the further evaporator/once-through heating area is thus promoted without any significant impairment of the homogenization achieved by the mixing in the discharge collector, whereby a particularly homogeneous flow medium is fed to the further once-through heating area simply because of the symmetrical arrangement of the discharge points from the respective entry collector relative to the longitudinal axis of the collector unit.

The steam generator is usefully used as a waste-heat steam generator of a gas- and steam-turbine plant. Here, the steam generator is advantageously connected downstream of a gas turbine on the heating-gas side. In this circuit arrangement, an additional furnace for raising the temperature of the heating gas can usefully be disposed behind the gas turbine.

The advantages achieved by means of the invention are in particular that as a result of the orientation of the discharge collector parallel to the heating-gas direction the property of the evaporator/once-through heating area which is in any case provided, namely a self-stabilizing circulation characteristic, can be utilized consistently for simplifying the distribution. It is precisely because of the self-stabilizing circulation characteristic that steam-generator tubes arranged behind one another, viewed in the heating-gas direction, can now also discharge at the outlet end with approximately equal steam states into a common discharge collector. In said discharge collector, the flow medium flowing out of the steam-generator tubes is mixed and prepared for forwarding to a subsequent heating-area system without impairing the homogenization achieved in the mixing process. In particular, the integration of outlet and entry collectors makes it possible for a separate distributor system, which is connected downstream of the evaporator/once-through heating area and is comparatively costly, to be dispensed with. Furthermore, the steam generator fashioned in this manner exhibits a comparatively low overall loss of pressure on the flow-medium side.

BRIEF DESCRIPTION OF THE DRAWINGS

An exemplary embodiment of the invention will be explained in detail with reference to drawings, in which.

The same parts are labeled with the same reference characters in all the Figures.

DETAILED DESCRIPTION OF THE INVENTION

Figure 1:
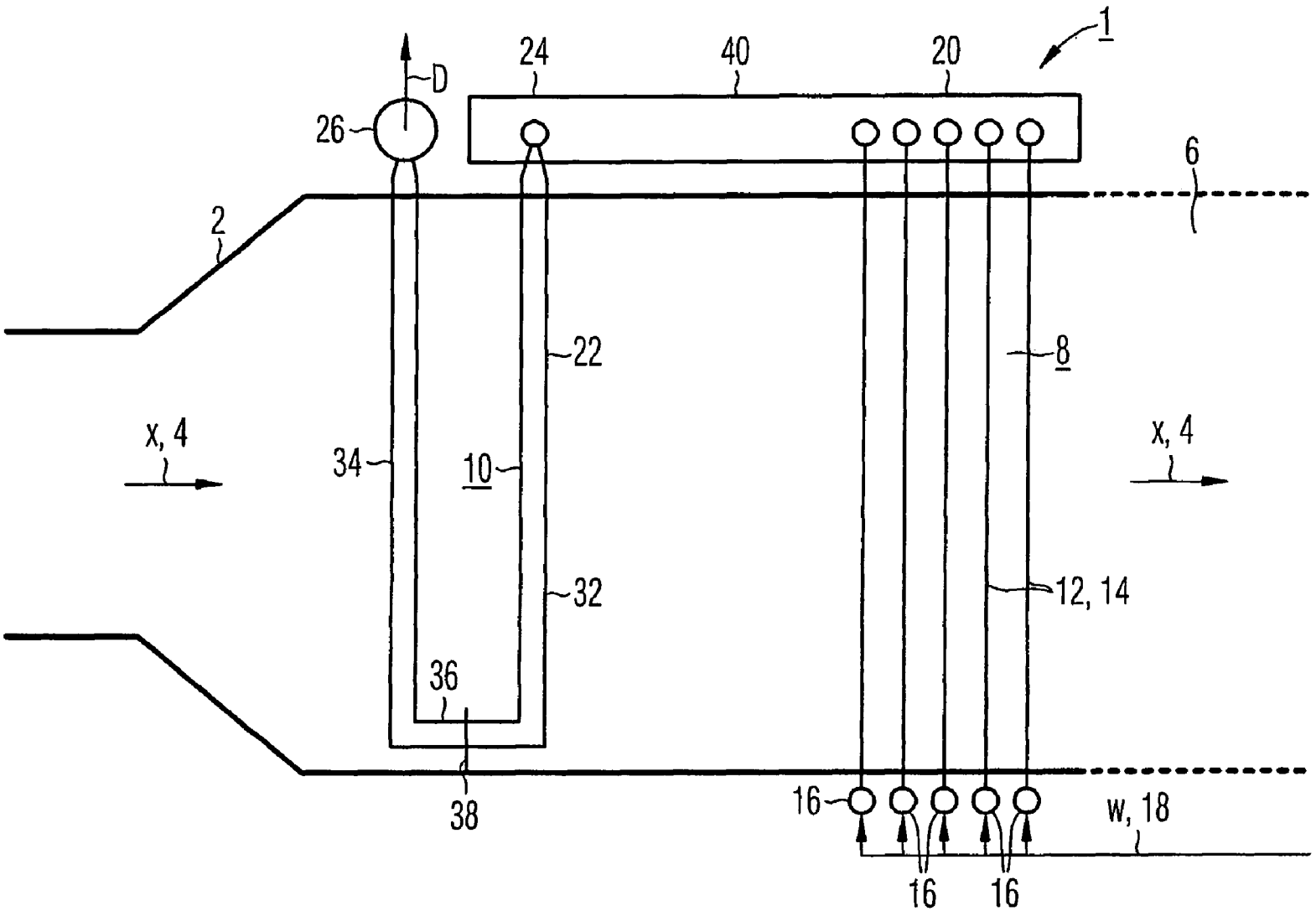
FIG. 1 shows in a simplified representation a longitudinal section of the evaporator section of a steam generator with a horizontal type of construction.

The steam generator 1 shown with its evaporator section in FIG. 1 is connected downstream in the manner of a waste-heat steam generator at the exhaust-gas end of a gas turbine, not shown in detail. The steam generator 1 has a containing wall 2 which forms a heating-gas duct 6 for the exhaust gas from the gas turbine, through which heating-gas duct said exhaust gas can flow in a approximately horizontal heating-gas-direction x indicated by the arrows 4. In the heating-gas duct 6 there are disposed a number (in the embodiment two) of evaporator heating areas 8, 10 which are configured in accordance with the once-through principle and which are connected behind one another for through flow by a flow medium W, D.

The multi-stage evaporator system formed from the evaporator/once-through heating areas 8, 10 can be loaded with a non-evaporated flow medium W which evaporates in a single pass through the evaporator/once-through heating areas 8, 10 and, after discharge from the evaporator/once-through heating area 10 is carried away as steam D and normally fed for further superheating to the superheater heating areas. The evaporator system formed from the evaporator/once-through heating areas 8, 10 is connected to the water/steam circuit (not shown in detail) of a steam turbine. In addition to this evaporator system, a number of further heating areas (not shown in detail in FIG. 1) are connected to the water/steam circuit of the steam turbine. These heating areas may for example be superheaters, intermediate-pressure evaporators, low-pressure evaporators and/or preheaters.

The evaporator/once-through heating area 8 is formed from a number of steam-generator tubes 12 connected in parallel for through flow by the flow medium W. The steam-generator tubes 12 are oriented with their longitudinal axis essentially vertical and are configured for through flow by the flow medium W from a lower entry region to an upper discharge region, that is from bottom to top.

The evaporator/once-through heating area 8 comprises in the manner of a nest of tubes a number of tube layers 14 arranged behind one another, viewed in the heating-gas direction x, each of which is formed from a number of steam-generator tubes 12 arranged side-by-side, viewed in the heating-gas direction x, and of which only one steam-generator tube 12 in each case can be seen in FIG. 1. Connected upstream of the steam-generator tubes 12 of each tube layer 14 is in each case a common entry collector 16, oriented with its longitudinal direction essentially perpendicular to the heating-gas direction x and disposed below the heating-gas duct 6. The entry collectors 16 are connected to a water feed system 18, which is indicated only schematically in FIG. 1 and which may comprise a distributor system for dividing according to requirements the afflux of flow medium W to the entry collectors 16. At the outlet end and thus in a region above the heating-gas duct 6, the steam-generator tubes 12 which form the evaporator/once-through heating area 8 discharge into a number of assigned discharge collectors 20.

The evaporator/once-through heating area 8 is configured such that it is suitable for feeding the steam-generator tubes 12 with a comparatively low mass flow, whereby the flow conditions in the steam-generator tubes 12 according to the design exhibit a natural circulation characteristic. With this natural circulation characteristic, a steam-generator tube 12 which is heated to a greater extent compared with a further steam-generator tube 12 of the same evaporator/once-through heating area 8 has a higher throughput of the flow medium W compared with said further steam generating tube 12.

The further evaporator/once-through heating area 10 which is connected downstream of the once-through heating area 8 on the flow-medium side is also configured according to the same principle, i.e. to set up a natural circulation characteristic. The further evaporator/once-through heating area 10 of the steam generator 1 also comprises in the manner of a nest of tubes a plurality of steam-generator tubes 22 which are connected in parallel and through which the flow medium W can flow. A plurality of steam-generator tubes 22 is in each case arranged side-by-side, viewed in the heating-gas direction x, forming a tube layer as it is called, such that in each case only one of the steam-generator tubes 22 of a tube layer which are arranged in said manner side-by-side is visible. In each case, an assigned distributor or entry collector 24 is disposed on the flow-medium side upstream and a shared discharge collector 24 downstream of the steam-generator tubes 22 which are arranged side-by-side in this manner.

In order in an especially reliable manner to ensure with especially simple design means the natural circulation characteristic provided according to the design for the further evaporator/once-through heating area 10, the further evaporator/once-through heating area 10 comprises two segments connected in series on the flow-medium side. In the first segment, each steam-generator tube 22 which forms the further evaporator/once-through heating area 10 comprises a downtake section 32 which is disposed approximately vertically and through which the flow medium W flows in a downward direction. In the second segment, each steam-generator tube 22 comprises an uptake section 34 which is connected downstream of the downtake section 32 on the flow-medium side and which is disposed approximately vertically and through which the flow medium W flows in an upward direction.

The uptake section 34 is connected here to the downtake section 32 assigned thereto via an overflow section 36. In the exemplary embodiment, the overflow sections 36 are conducted inside the heating-gas duct 6.

Each steam-generator tube 22 of the further evaporator/once-through heating area 10 has, as can be seen in FIG. 1, a virtually U-shaped form, whereby the limbs of the U are formed by the downtake section 32 and the uptake section 34 and the connecting arc by the overflow section 36. In a steam-generator tube 22 configured in this way, the geodetic pressure contribution of the flow medium W in the region of the downtake section 32 generates—in contrast to the region of the uptake section 34—a flow-promoting and not a flow-restricting pressure contribution. In other words, the water column of non-evaporated flow medium W located in the downtake section 32 also helps to "push" the through flow of the respective steam-generator tube 22, rather than hampering it. Viewed overall, the steam-generator tube 22 exhibits as a result a relatively low loss of pressure.

With the approximately U-shaped type of construction, each steam-generator tube 22 is, in the entry region of its downtake section 32 and in the discharge region of its uptake section 34, suspended from or fastened to the roof of the heating-gas duct 34 in the manner of a hanging type of construction. The, viewed spatially, lower ends of the respective downtake section 32 and of the respective uptake section 34, which ends are connected to one another via their overflow section 36 are, by contrast, not fixed directly spatially to the heating-gas duct 6. Extensions in length of these segments of the heat-generating tubes 22 can thus be tolerated without risk of damage, the respective overflow section 36 acting as an expansion arc. This arrangement of the steam-generator tubes 22 is thus mechanically especially flexible and, with regard to thermal stresses, insensitive to differential expansions occurring.

The steam generator 1 is configured for reliable, homogeneous flow management while retaining a relatively simple type of construction. Here, the natural circulation characteristic provided according to the design for the evaporator/once-through heating area 8 is utilized consistently for simplification of the distributor system. This natural circulation characteristic and the associated relatively low mass flow which is provided according to the design enable namely the merging of the partial flows from steam-generator tubes which are arranged behind one another, viewed in the heating-gas direction x, and are thus heated to differing degrees into a common chamber. In economizing on the need for an independent and costly distributor system, it is thus possible to shift the mixing of the flow medium W flowing out of the evaporator/once-through heating area 8 into the discharge collector(s) 20. In order to impair as little as possible the homogenization achieved in this process of flow medium W flowing out of heat-generating tubes 12 which are positioned differently, viewed in the direction of flow of the heating gas x, and are thus heated to differing degrees when forwarding said flow medium into subsequent systems, each of the discharge collectors 20 which are disposed essentially parallel to one another and adjacent to one another, of which only one is visible in FIG. 1, is oriented with its longitudinal axis essentially parallel to the heating-gas direction x. The number of discharge collectors 20 is matched here to the number of steam-generator tubes 12 in each tube layer 14.

An entry collector 24 of the further once-through heating area 10 connected downstream on the flow-medium side of the once-through heating area 8 is assigned to each discharge collector 20. Due to the U-shaped design of the further once-through heating area 10, the respective entry collector 24 is, like the respective discharge collector 20, located above the heating-gas duct 6. The connection of the once-through heating area 8 and the further once-through heating area 10 behind one another on the flow-medium side is possible here in an especially simple manner in that each discharge collector 20 is integrated with the entry collector 24 assigned to it respectively into a structural unit 40. The structural or design unit 40 enables a direct overflow of the flow medium W from the evaporator/once-through heating area 8 into the further evaporator/once-through heating area 10 without the need for a relatively costly distributor or connection system.

In the steam generator 1 with a horizontal type of construction and using the further evaporator/once-through heating area 10 with steam-generator tubes 22 having an essentially u-shaped design, steam bubbles can occur in the downtake section 32 of a steam-generator tube 22. These steam bubbles could rise in the respective downtake section 32 counter to the direction of flow of the flow medium W and thus hamper the stability of the flow and also the reliable operation of the steam generator 1. In order reliably to prevent this, the steam generator 1 is configured for feeding the further evaporator/once-through heating area 10 with flow medium W which is already partly evaporated.

Here, a feed of the flow medium W to the further evaporator/once-through heating area 10 is provided such that the flow medium W has a flow velocity in the downtake section 32 of the respective steam-generator tube 22 greater than a predeterminable minimum velocity. This is measured in turn such that due to the flow velocity of the flow medium W in the respective downtake section 32 being sufficiently high, steam bubbles possibly present there are reliably carried away in the direction of flow of the flow medium W and transferred via the respective overflow section 36 to the uptake section 34 connected downstream in each case. Adherence in the downtake sections 32 of the steam-generator tubes 22 to a flow velocity of the flow medium W which is sufficiently high for this purpose is ensured by the feed of the flow medium W to the further evaporator/once-through heating area 10 being provided with a sufficiently high steam content for this purpose and/or with a sufficiently high enthalpy for this purpose.

In order to enable the feed of the flow medium W with parameters suitable for this purpose in an already partly evaporated state, the evaporator/once-through heating area 8 is connected upstream on the flow-medium side of the further evaporator/once-through heating area 10 of the steam generator 1 in the manner of a pre-evaporator. The evaporator/once-through heating area 8 provided in the manner of a pre-evaporator is disposed spatially in a comparatively colder spatial area of the heating-gas duct 6 and thus downstream of the further evaporator/once-through heating area 10 on the heating-gas side. The further evaporator/once-through heating area 10, by contrast, is disposed near to the entry region of the heating-gas duct 6 for the heating gas flowing out of the gas turbine and thus exposed when in operation to a comparatively powerful heat input by the heating gas.

In order to ensure, in accordance with the configuration of the evaporator system formed by the once-through heating area 8 and by the further once-through heating area 10 connected downstream on the flow-medium side of said once-through heating area 8, namely in the case of the configuration, the feeding on the entry side of the further evaporator/once-through heating area 10 with partly pre-evaporated flow medium W which exhibits a sufficiently high steam content and/or a sufficiently high enthalpy, the evaporator/once-through heating area 8 is dimensioned appropriately. Consideration must be given here, in particular, to a suitable choice of material and a suitable dimensioning of the steam-generator tubes 12, as well as a suitable positioning of the steam-generator tubes 12 relative to one another. It is precisely in relation to these parameters that the evaporator/once-through heating area 8 is dimensioned such that, when in operation, the flow medium W flowing into the further evaporator/once-through heating area 10 connected downstream of said evaporator/once-through heating area 8 has a flow velocity greater than the minimum velocity required for carrying along steam bubbles which arise or are present in the respective downtake sections 32.

As it has turned out, the high operating safety sought in accordance with the design is attainable to an especial degree in that the average heat absorption in operation is distributed essentially evenly between the evaporator/once-through heating area 8 and the further evaporator/once-through heating area 10. The evaporator/once-through heating areas 8, 10 and the steam-generator tubes 12 or 22 forming said evaporator/once-through heating areas are therefore dimensioned in the exemplary embodiment such that in operation the overall heat input into the steam-generator tubes 12 forming the evaporator/once-through heating area 8 approximately matches the heat input into the steam-generating tubes 22 forming the further evaporator/once-through heating area 10. Taking into account the mass flows occurring in this process, the evaporator/once-through heating area 8 has for this reason an appropriately selected number of steam-generator tubes 12 in relation to the number of steam-generator tubes 22 of the further evaporator/once-through heating area 10 connected downstream of it on the flow-medium side.

Figure 2:
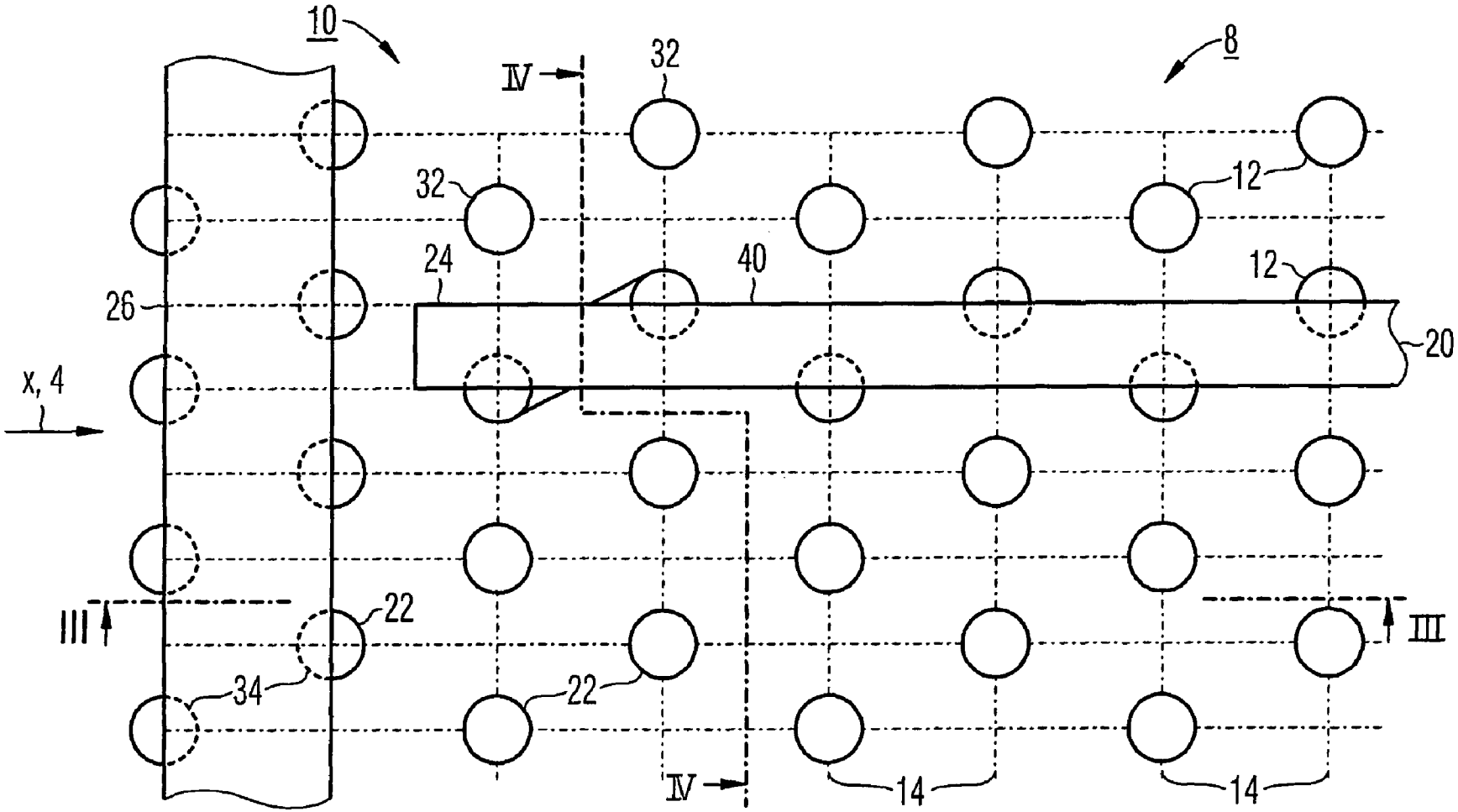
FIG. 2 shows sections of the steam generator according to FIG. 1 in plan view.

As shown in plan view in section in FIG. 2, the steam-generator tubes 12 of two adjacent tube layers 14 are in each case arranged in a direction perpendicular to the heating-gas direction x and offset in relation to one another, so that in terms of the arrangement of the steam-generator tubes 12 a basic pattern is produced that is essentially rhomboid. In this arrangement, the discharge collectors 20, of which only one is shown in FIG. 2, are positioned such that one steam-generator tube 12 from each tube layer 14 in each case discharges into each discharge collector 20. It can also be seen here that each discharge collector 20 is integrated with an assigned entry collector 24 for the further evaporator/once-through heating area 10 connected downstream of the evaporator/once-through heating area 8 to form a structural unit 40.

It can also be seen from FIG. 2 that the steam-generator tubes 22 which form the further evaporator/once-through heating area 10 also form a number of tube layers disposed behind one another, viewed in the heating-gas direction x, whereby the first two tube layers, viewed in the heating-gas direction x, are formed from the uptake sections 34 of the steam-generator tubes 22 which discharge at the outlet end into the discharge collector 26 for the evaporated flow medium D. The next two tube layers, on the other hand, viewed in the heating-gas direction x, are formed from the downtake sections 32 of the steam-generator tubes 22 which are connected at the inlet end to a respectively assigned entry collector 24.

Figure 3:
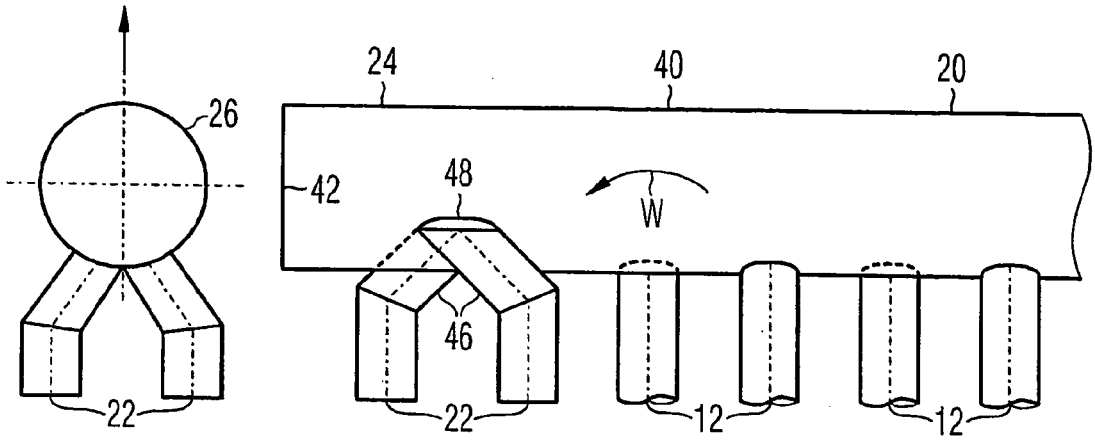
FIG. 3 shows the steam generator according to FIG. 1 in section along the line of intersection shown in FIG. 2.

FIG. 3 shows section-wise in side view the discharge region of the steam-generator tubes 12, 22 into the respectively assigned structural unit 40 which comprises on the one hand the discharge collector 20 for a number of steam-generator tubes 12 forming the evaporator/once-through heating area 8 and on the other hand the entry collector 24 for, in each case, two of the steam-generator tubes 22 forming the further evaporator/once-through heating area 10. It is particularly clear from this representation that flow medium W flowing out of the steam-generator tubes 12 and flowing into the discharge collector 20 can overflow directly into the entry collector 24 assigned to the further evaporator/once-through heating area 10. When the flow medium W overflows, said flow medium strikes, depending on the operating state, firstly against the base plate 42 of the structural unit 40 comprising the entry collector 24. As a consequence of this impact, a swirling and particularly an internal intermixing of the flow medium W occurs before this flow medium W passes from the entry collector 24 into the downtake sections 32 of the assigned steam-generator tubes 22.

As is also particularly clear in the representation according to FIG. 3, the end part of the structural unit 40 fashioned as an entry collector 24 for the steam-generator tubes 22 is configured such that the outflow of the flow medium W into the steam-generator tubes 22 occurs for all steam-generator tubes 22 from a single plane perpendicular to the cylinder axis of the structural unit 40. In order to enable this also for two steam-generator tubes 22 which, in relation to their actual spatial positioning, have to be assigned to two different tube layers arranged behind one another, viewed in the heating-gas direction x, one overflow section 46 is in each case assigned to each steam-generator tube 22. Each overflow section 46 runs obliquely to the heating-gas direction x and connects the upper region of the respectively assigned steam-generator tube 22' to the respective discharge opening 48 of the entry collector 24. By means of this arrangement, all discharge openings 48 of the entry collectors 24 can be positioned in a common plane perpendicular to the cylinder axis of the structural unit 40 so that an even distribution of the flow medium D, W entering the steam-generator tubes 22 is ensured simply on account of the symmetrical arrangement of the discharge openings 48 in relation to the flow path of the flow medium D, W.

Figure 4:
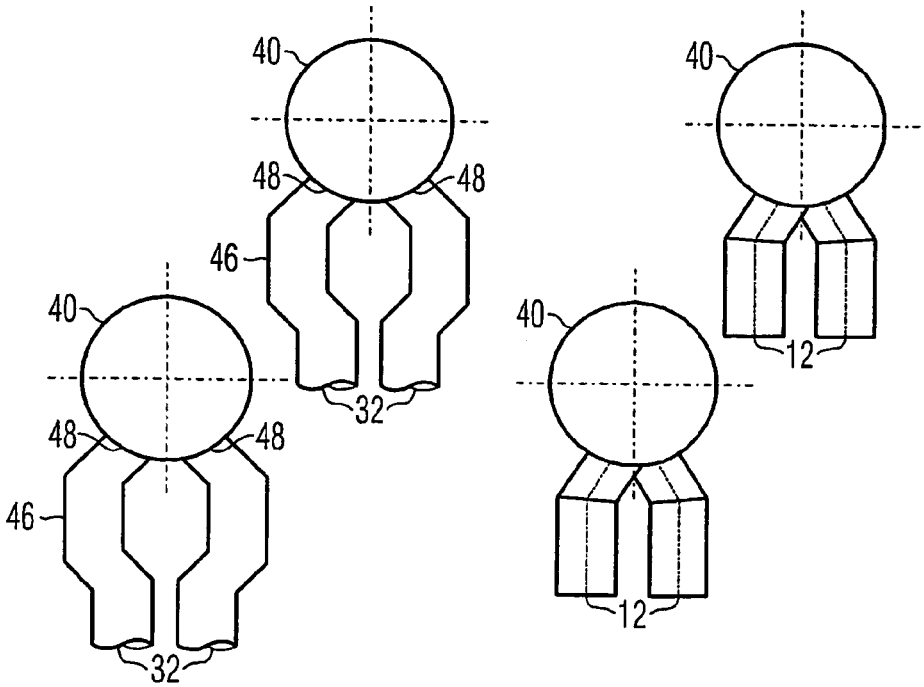
FIG. 4 shows the steam generator according to FIG. 1 in section along the line of intersection shown in FIG. 2.

To further clarify the tube layouts in the region of their intakes and discharges into or out of the structural unit 40, a number of such structural units 40 is shown in FIG. 4 in front view, whereby the line of intersection marked IV in FIG. 2 is taken as the base. It can be seen here that the two structural units 40 shown on the left in FIG. 4, which structural units 40 are shown in the region of their end fashioned as an entry collector 24 for the steam-generator tubes 22 connected downstream, are each connected via the overflow sections 46 to the downtake sections 32 of the steam-generator tubes 22 which are disposed downstream.

In comparison with this, the two structural units 40 represented on the right in FIG. 4 are each shown in the region of their front area which is fashioned as a discharge collector 20 for the steam-generator tubes 12 of the evaporator/once-through heating area 8. It can be seen from the representation that the steam-generator tubes 12 discharging from the tube layers 14 which in each case lie behind one another into the structural unit 40 are conducted into the structural unit 40 in simply angled form.

The steam generator 1 according to FIG. 1 and with the particular configurations according to FIGS. 2 to 4 is configured for particularly safe operation of the further evaporator/once-through heating area 10. To this end, it is ensured when the steam generator 1 is being operated that the evaporator heating area 10 which is fashioned essentially U-shaped is loaded with flow medium W having a flow velocity greater than a predetermined minimum velocity. This achieves the result that steam bubbles present in the downtake sections 32 of the steam-generator tubes 22 forming the further evaporator/once-through heating area 10 are also carried away and brought to the uptake section 34 connected downstream in each case. In order to ensure a sufficiently high flow velocity in the flow medium W flowing into the further evaporator/once-through heating area 10, the further evaporator/once-through heating area 10 is fed using the evaporator/once-through heating area 8 connected upstream thereof such that the flow medium W flowing into the further evaporator/once-through heating area 10 has a steam content or an enthalpy greater than a predetermined minimum steam content or greater than a predetermined minimum enthalpy. To adhere to operating parameters suitable for this purpose, the evaporator/once-through heating areas 8, 10 are configured or dimensioned such that in all operating points the steam content or the enthalpy of the flow medium D, W lies, upon entry into the further evaporator/once-through heating area 10, above suitably predetermined characteristic curves, as shown by way of example in FIGS. 5*a*, 5*b*.

Figure 5A:
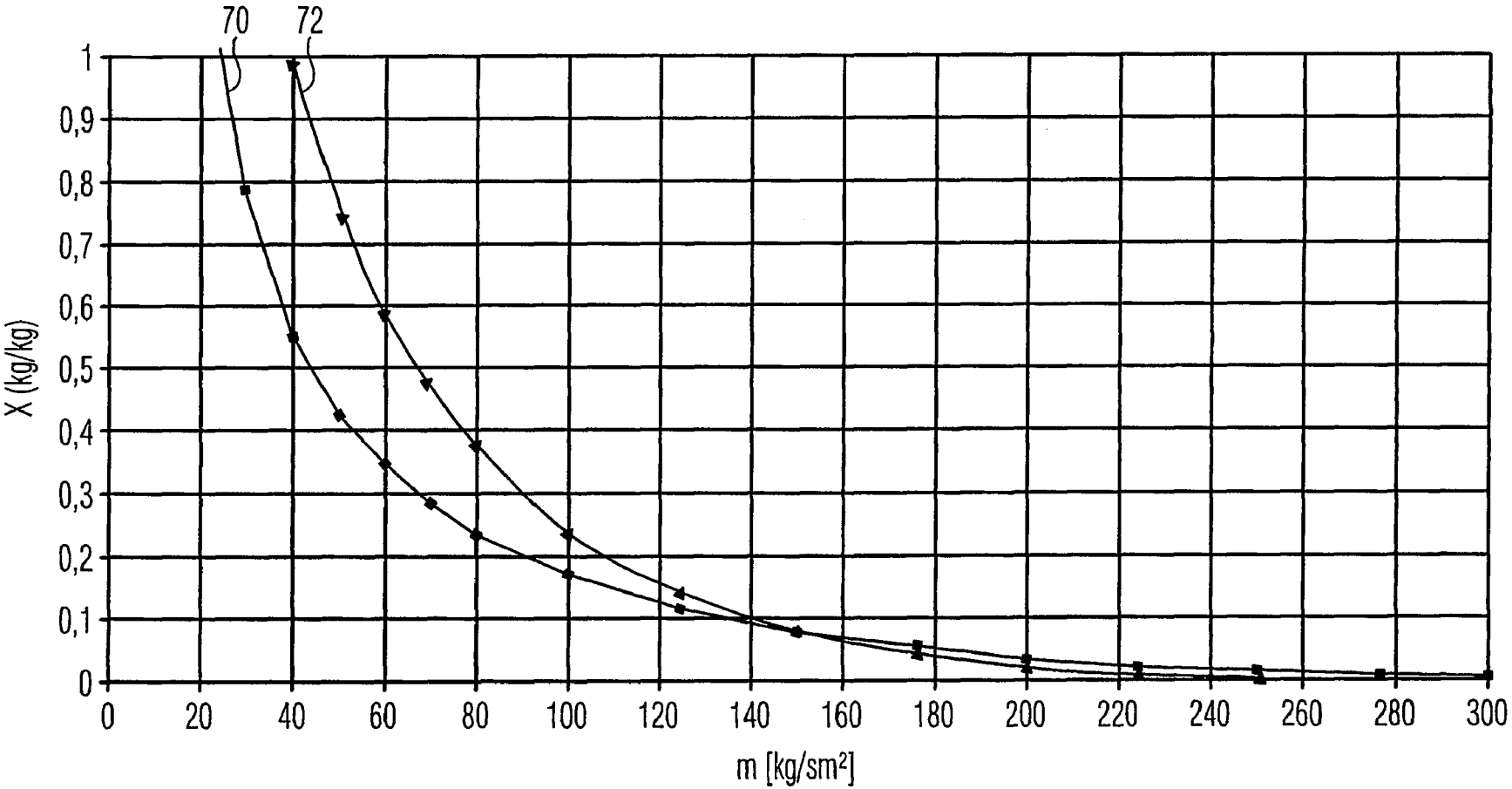
FIG. 5*a* shows a steam content /mass-flow diagram.
Figure 5B:
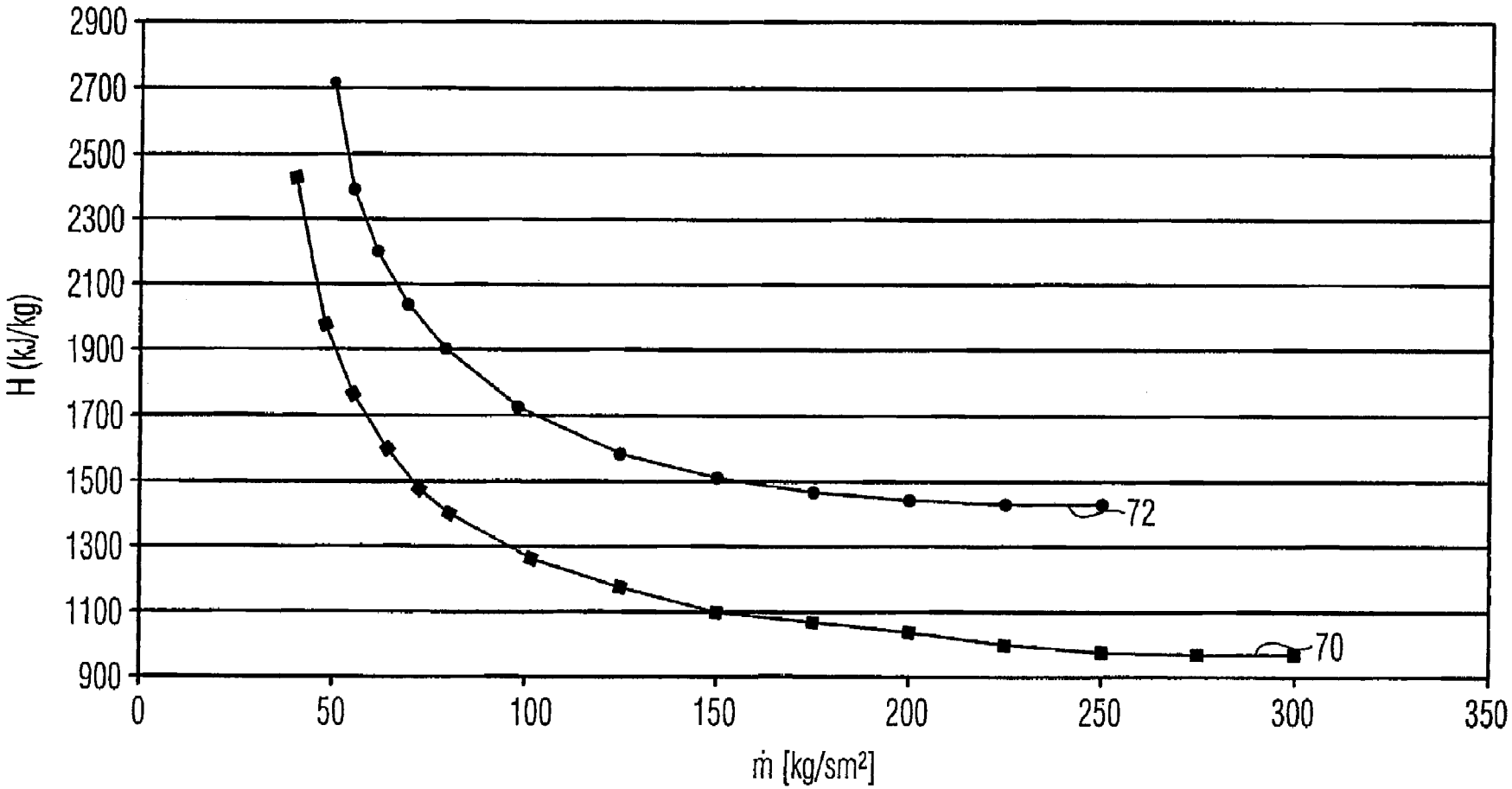
FIG. 5*b* shows an enthalpic /mass-flow diagram.

FIGS. 5*a*, 5*b* show in the manner of a set of curves with the operating pressure as the set parameter the functional dependence of the minimum proportion of steam to be set $X_{min}$ or of the minimum enthalpy to be set $H_{min}$ as a function of the mass flow m chosen according to the configuration. Shown here as a curve 70 is the configuration criterion in each case for an operating pressure of p=25 bar, while the curve 72 is provided in each case for an operating pressure of p=100 bar.

Thus it can be seen from these sets of curves, for example, that when operating at partial loading with a configuration mass flow m of 100 kg/m$^2$s and an anticipated operating pressure of p=100 bar it should be ensured that the steam content $X_{min}$ in the flow medium W flowing to the once-through heating area 8 should have a value of at least 25%, preferably about 30%. In an alternative representation of this configuration criterion, it can also be provided that the enthalpy of the flow medium W flowing to the once-through heating area 8 should, under the designated operating conditions, have a minimum value of H=1750 kJ/kg. The further once-through heating area 10 provided according to the configuration for adhering to these conditions is adapted in terms of its dimensioning, i.e. for example in terms of the type, number and design of the steam-generator tubes 30 which form it, to these limiting conditions, taking into account the heat supply available according to the configuration in the chamber area, provided for its spatial positioning, inside the heating-gas duct 6.

The invention claimed is:

1. A steam generator, comprising:

an evaporator or once-through heating area comprising a number of steam-generator tubes that are connected in parallel and through which a flow medium flows, and configured such that a steam-generator tube that is heated to a greater extent compared with a further steam-generator tube of the same evaporator or once-through heating area has a greater throughput of the flow medium than the further steam-generator tube, wherein the steam generator tubes are disposed within a heating-gas duct;

a heating gas that flows in a substantially horizontal direction through the heating gas duct; and a discharge collector that is connected downstream of the steam-generator tubes of the evaporator or once-through heating area on the flow-medium side and is oriented with its longitudinal axis essentially parallel to the heating-gas direction; and a further evaporator or once-through heating area disposed on the flow-medium side downstream of the evaporator or once-through heating area, wherein steam-generator tubes forming the further evaporator or once-through heating area each have a downtake section which is disposed approximately vertically and through which the flow medium can flow in a downward direction, the downtake section is connected by an overflow section to an uptake section which is connected downstream of said downtake section on the flow-medium side, and which is disposed approximately vertically and through which the flow medium can flow in an upward direction.

2. The steam generator according to claim 1, wherein the respective discharge collector essentially a cylindrical body.

3. The steam generator according to claim 1, wherein the evaporator or once-through heating area further comprises a number of tube layers arranged one behind another as viewed in the heating-gas direction, each of the tube layers being formed from a number of steam-generator tubes arranged side-by-side as viewed in the heating-gas direction.

4. The steam generator according to claim 3, wherein the evaporator or once-thr ough heating area is assigned a number corresponding to the number of steam-generator tubes in each tube layer, of discharge collectors, and oriented with their longitudinal axis essentially parallel to the heating-gas direction, whereby one steam-generator tube of each tube layer discharges into each discharge collector.

5. The steam generator according to claim 4, wherein the further evaporator or once-through heating area further comprises a number of steam-generator tubes that are connected in parallel and through which a flow medium flows, and wherein a steam-generator tube which is heated to a greater extent compared with a further steam-generator tube of the further evaporator or once-through heating area has a greater throughput of the flow medium compared with said further steam-generator tube.

6. The steam generator according to claim 5, wherein the evaporator or once-through heating area is dimensioned to provide the flow medium flowing into the further once-through heating area connected downstream thereof a flow velocity greater than the minimum velocity required in order to carry along any steam bubbles present in the evaporator during operation.

7. The steam generator according to claim 6, wherein the discharge collector of the evaporator or once-through heating area is integrated in a structural unit with a respectively assigned entry collector of the further once-through evaporating heating unit connected downstream on the flow-medium side.

8. The steam generator according to claim 7, wherein the discharge collector is disposed above the heating-gas duct.

9. The steam generator according to claim 7, wherein the steam generator is located upstream of which a gas turbine and is connected on a heating-gas side.

* * * * *